US007913349B2

(12) United States Patent
Byrnes

(10) Patent No.: US 7,913,349 B2
(45) Date of Patent: Mar. 29, 2011

(54) TWO BLADE SCRAPING DEVICE

(76) Inventor: James Michael Byrnes, Louisville, CO (US)

( * ) Notice: Subject to any disclaimer, the term of this patent is extended or adjusted under 35 U.S.C. 154(b) by 1065 days.

(21) Appl. No.: 11/373,781

(22) Filed: Mar. 13, 2006

(65) Prior Publication Data

US 2006/0200932 A1 Sep. 14, 2006

Related U.S. Application Data

(60) Provisional application No. 60/661,371, filed on Mar. 14, 2005.

(51) Int. Cl.
*A47L 13/08* (2006.01)

(52) U.S. Cl. ..... 15/236.06; 15/236.01; 15/236.05

(58) Field of Classification Search .. 15/236.01–236.09, 15/104.68; 30/172, 173, 169; 209/215; 294/19.1, 294/16, 24

See application file for complete search history.

(56) References Cited

U.S. PATENT DOCUMENTS

| | | | | |
|---|---|---|---|---|
| 2,236,093 | A | 4/1939 | Friend | |
| 3,787,921 | A | 1/1974 | Feldmann | |
| 4,305,175 | A | 12/1981 | Burgess | |
| 4,481,689 | A | 11/1984 | Westmoreland | |
| 4,984,324 | A * | 1/1991 | Farris | 15/236.05 |
| 5,263,222 | A | 11/1993 | Johnstone | |
| 5,471,698 | A | 12/1995 | Francis et al. | |
| 6,018,836 | A | 2/2000 | Williams | |
| 6,139,077 | A * | 10/2000 | Molzan, II | 294/19.1 |
| 6,243,906 | B1 | 6/2001 | Holliday et al. | |
| 6,471,271 | B1 * | 10/2002 | Segal | 294/19.1 |
| 6,516,490 | B1 | 2/2003 | Hatala | |
| 7,437,794 | B2 * | 10/2008 | Massaro | 15/236.06 |
| 2002/0095737 | A1 * | 7/2002 | Panfili et al. | 15/143.1 |

* cited by examiner

*Primary Examiner* — Dung Van Nguyen

(57) ABSTRACT

A hand-held scraper device containing a stowable multi blade pivoting head. The pivoting head is comprised of at least two scraping elements which remain at a fixed angle relative to each other while still allowing a pivoting action of the head assembly independently from the handle. The angle of the scraping elements relative to each other is set such that as the two scraping elements are jointly presented against the work surface they will be maintained at an angular attitude conducive to a scraping action in both a push and pull direction. The pivoting head can be collapsed for more efficient stowage or as an alternate configuration for specific scraping applications.

4 Claims, 4 Drawing Sheets

TWO BLADE SCRAPING DEVICE

REFERENCE TO RELATED APPLICATIONS

This application is entitled to the benefit of Provisional Patent Application No. 60/661,371, filed Mar. 14, 2005.

FIELD OF THE INVENTION

This device relates to a handheld manual-powered scraping tool employing a pivotable and stowable head for removing material from a work surface.

BACKROUND OF THE INVENTION

There have been more than 200 patents granted over the years for devices of a wide variety of forms intended to be used for human powered removal of material from a surface through the use of scraping action. One of the most common commercial usages of these devices has focused on the removal of ice from automobile windshields. Although there have been several improvements over time related to their performance, ergonomics, and ease of use, the author believes there are additional attributes and novel features that would further improve upon the functionality and commercial viability of these devices.

Devices such as the paint scraper U.S. Pat. No. 4,984,324 by Farris provides a dual push-pull scraping head located at the end of a handle, but doesn't take advantage of stowing or pivoting features. Gutter cleaning devices U.S. Pat. No.6,139,077 by Molzan and U.S. Pat. No. 6,471,271 by Segal employ pivoting blades mounted to an extensible handle, but requires a cord for blade stowage (for the intent of remotely gathering leaves between the blades) and a spring for positioning the blades in their open position. The ergonomic scraper per US 2002/0095737 A1 by Panfill is comprised of a leveraging handle and a dual blade head for scraping, but is not configured with a pivoting or stowable scraping head.

There have been several devices intended primarily for automobile glass which feature a multi-blade pivoting scraping head. U.S. Pat. No. 2,236,093 by Friend (1939) is the earliest concept employing a multi-blade pivoting head. U.S. Pat. No. 5,471,698 Francis-Rouse (1995) might be considered a modernized version updated with a leveraging handle. U.S. Pat. No. 6,018,836 Williams (2000) is another form of the multi-blade pivoting head concept. Although all may be functional by design, they cannot be stowed conveniently within the automobile and are limited in their usefulness due to their implied size and in some cases to the inflexibility of the blades. If they are sized for scraping larger surfaces such as windshields, they would be too large to be practical for use on small surfaces such as rear-view mirrors, nor could they be stowed in a typical sized car door pocket. Most of the other devices with related patents provide a rigid scraping blade which is ineffective for conforming to non-flat surfaces such as automobile glass.

The device described herein employs the beneficial features of a multi-blade scraping head but also adds other novel features as described below to enhance its effectiveness and usefulness by addressing the aforementioned shortcomings and concerns.

SUMMARY OF THE INVENTION

The device is a handheld manual-powered scraping tool employing a pivotable multi blade head for removing material from a work surface. This scraper which employs two blade elements set at the appropriate relative angle to allow scraping in push and pull directions provides efficiency advantages over a scraper using a single blade. In the preferred embodiment, mounting the two blade head onto a handle that can pivot independently from the head provides ergonomic and functional advantages over a conventional fixed head scraper by maintaining the most efficient scraping angle of blades relative to the work surface independently of the operators preferred handle holding position. The pivoting head is configured with intentionally flexible blade elements to allow the blades to conform to the work surface, thereby allowing fewer operator strokes when the device is used to remove material from a curved surface such as ice from automobile glass. The device also provides a means to stow the pivotable head in a collapsed configuration to allow convenient storage of the device and to provide a means to protect the blades from damage when not in use. In the preferred embodiment, a central fixed third blade allows scraping of smaller surfaces such as automobile rearview mirrors when the device is configured for ice removal.

DESCRIPTION OF THE DRAWING FIGURES

FIG. 4A is an isometric view of the second alternate embodiment shown in the stowed configuration.

FIG. 4B is an isometric view of the second alternate embodiment shown in the working configuration.

FIG. 4C is an isometric view of the second alternate embodiment shown with the removable handle separated from the scraping attachment assembly.

REFERENCE NUMERALS FOR THE FIGURES

Figure 1A:
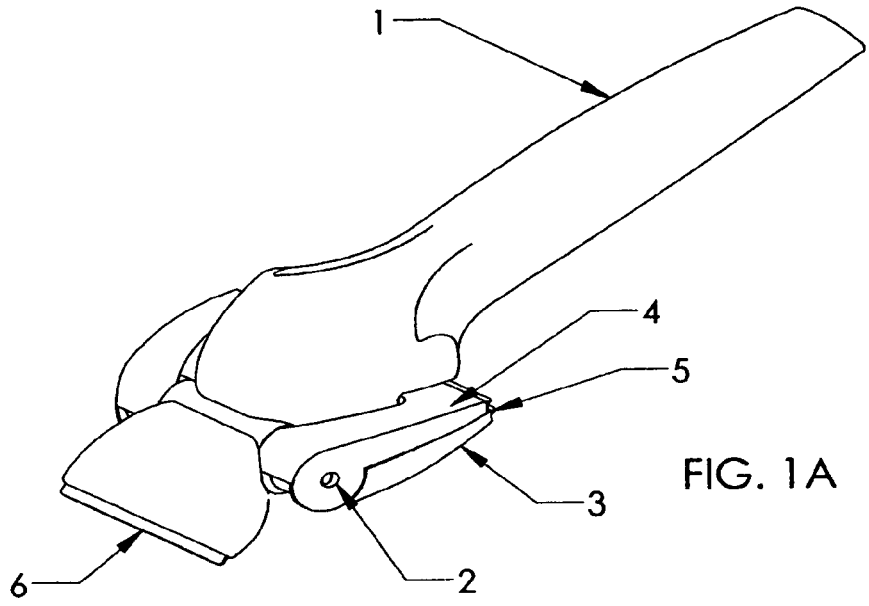
FIG. 1A is an isometric view of the preferred embodiment with the scraping blades stowed back.

1 Handle
2 Pivot shaft
3 Scraping element, front
4 Scraping element, rear
5 Enhanced scraping blade
6 Fixed scraping blade
7 Work surface
8 Concave cam feature—stow-deploy
9 Convex cam feature—stow-deploy
10 Convex cam feature—pivot lock
11 Concave cam feature—pivot lock
12 Telescoping handle
13 Brush head

DETAILED DESCRIPTION OF THE PREFERRED EMBODIMENT

Figure 1B:
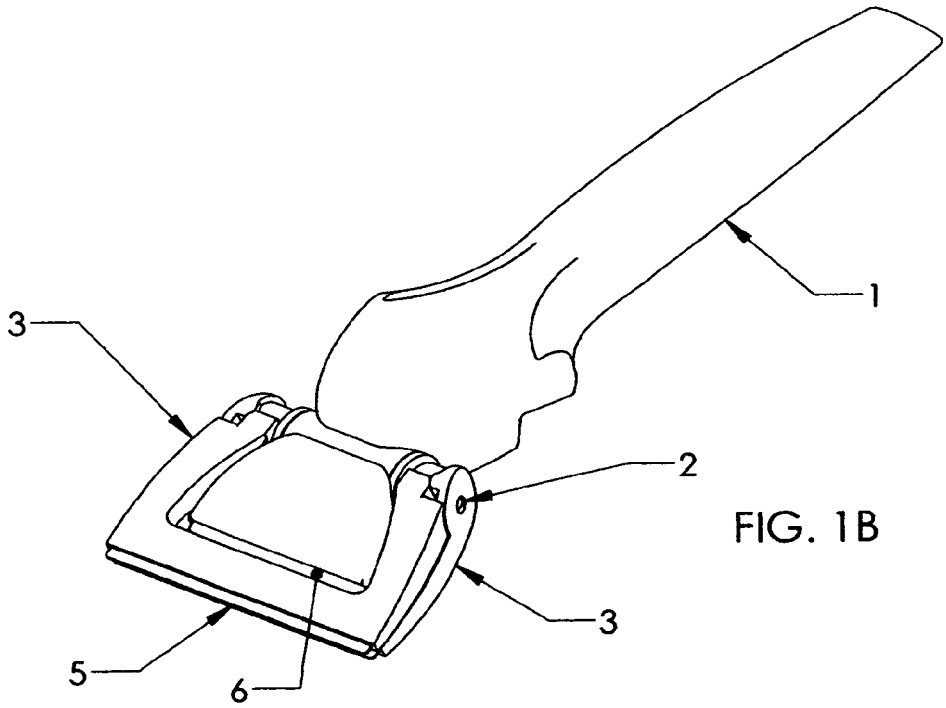
FIG. 1B is an isometric view of the preferred embodiment with the scraping blades stowed forward.
Figure 1C:
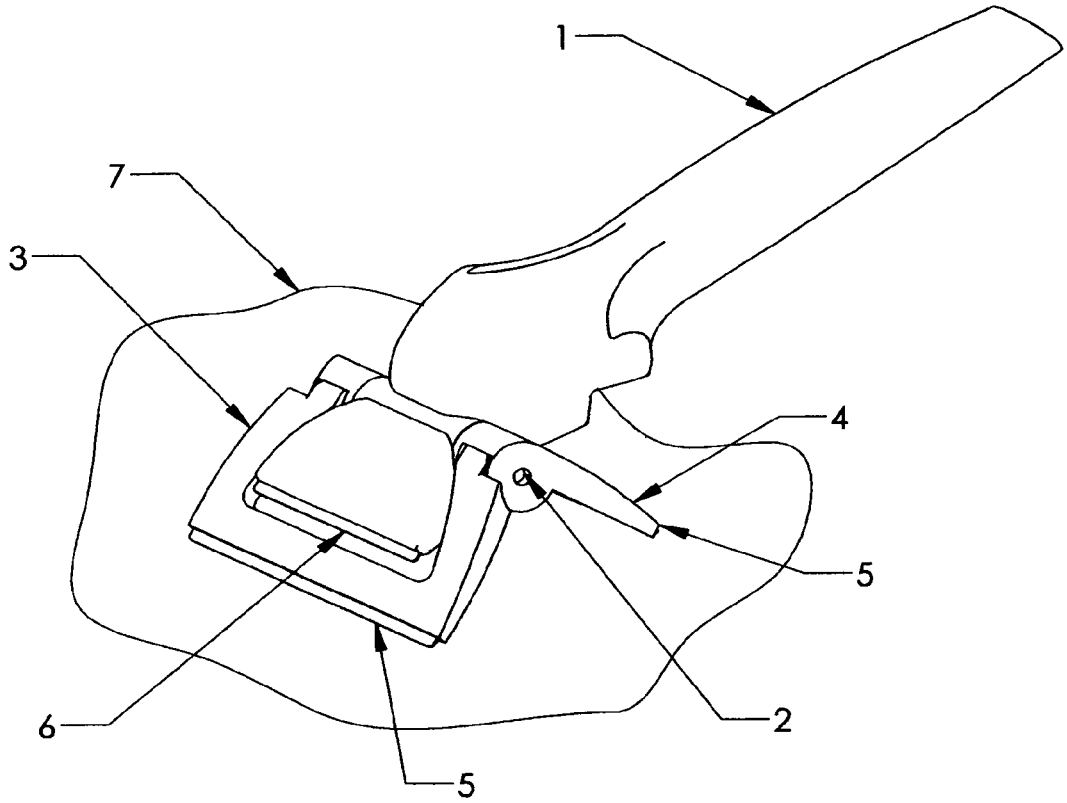
FIG. 1C is an isometric view of the preferred embodiment with the scraping blades deployed.

Referring to FIG. 1C, the scraping device consists of a handle 1, a pivot shaft 2, and two planar scraping elements 3 and 4. Optionally, the scraping elements 3 and 4 may be augmented with item 5 blades affixed to their scraping edges to facilitate removal of material from the work surface 7. Also a fixed scraping blade item 6 may be affixed to either end of the handle 1 as an additional scraping element to be used independently from scraping elements 3 and 4. FIGS. 1A,B,C and 2 are views of the preferred embodiment FIG. 1A is a view of the device in the stowed back configuration for storage or for scraping with the fixed blade element 6. FIG. 1B is a view demonstrating the capability of stowing the scraping elements 3, 4 in a forward alternate configuration advantageous for certain scraping applications. FIG. 1C is a view of the device in the deployed configuration for scraping with the pivotable blade elements 3 and 4.

The scraping elements 3 and 4 are related in shape and size, each having a planar form comprised of a straight edge ended for scraping against the work surface 7. The scraping elements 3 and 4 are mutually attached via a pivot shaft 2 at each respective end opposing its scraping edge such that the pivot shaft 2 provides a pivot axis parallel to the scraping edges for both scraping elements 3 and 4.

Figure 2:
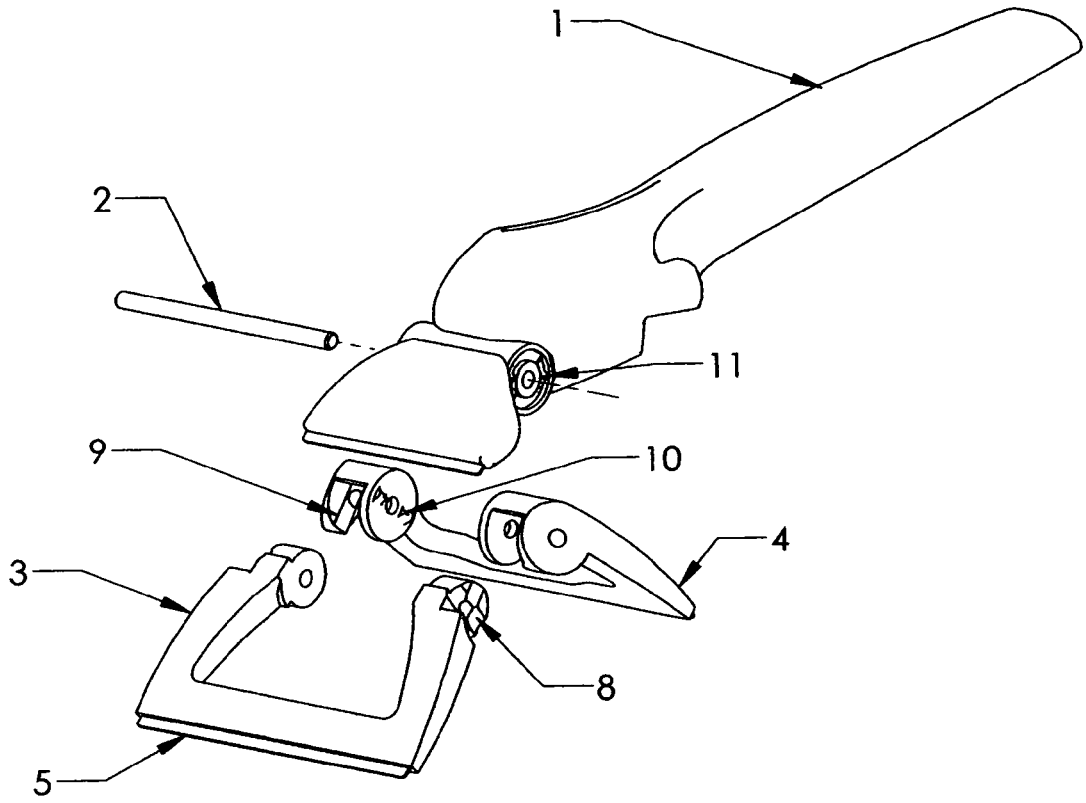
FIG. 2 is an exploded view of the scraping assembly.

FIG. 2 is an exploded view of the scraper assembly exposing the details of the pivot axis region. The scraping elements 3 and 4 contain mechanical interfering features at their pivot shaft end to limit the amount of angular displacement to approximately 90 degrees relative to each other. Also, element 3 contains concave cam features at each end boss while element 4 contains mating convex cam features 9 located to provide clocking detents at the 0 degree stowed and 90 degree deployed limits of elements 3 and 4. These cam features allow the scraping elements 3 and 4 to lock into a deployed state relative to each other yet allow them to pivot as a single unit about the shaft 2. Similarly, convex cams item 10 located on the boss features of item 4 interface with concave cam features 11 in handle 1 to provide clocking detents of the item 2, 3, 4 assembly relative to handle 1 for retaining the stowed element 3, 4 assembly in either of two stowed positions: stowed forward as shown in FIG. 1B or stowed back as shown in FIG. 1A.

OPERATION OF THE PREFERRED EMBODIMENT

With the scraping device in the stowed back configuration as shown in FIG. 1A the scraping elements 3 and 4 are positioned to minimize the overall volume for storage. This is also the configuration for use of the fixed blade 6 for specifically tough or small tasks. For certain applications where a larger fixed blade is preferred, the 3, 4 elements assembly may be stowed forward as shown in FIG. 1B. This configuration allows the scraper to be used in a conventional fashion.

To operate the scraping device in the pivoting configuration shown in FIG. 1C with both elements 3, 4 in contact with the work surface 7, both elements are rotated about shaft item 2 until they lock into the deployed position of approximately 90 degrees relative to each other. With the outboard edges of scraping elements 3 and 4 in contact with the work surface 7 as shown in FIG. 1C, the user is able to simultaneously apply downward force and forward or rearward motion into the tool handle 1 while pivoting the handle 1 about the shaft 2 to facilitate the reach and comfort of the user. Throughout these pivoting and scraping motions by the user the novel configuration of the scraping device ensures that the two scraping elements 3 and 4 both remain in contact with the work surface 7 and at the predetermined angle found to be effective for scraping regardless of the angle of the handle 1 relative to the work surface 7.

DETAILED DESCRIPTION AND OPERATION OF ALTERNATE EMBODIMENTS

Figure 3A:
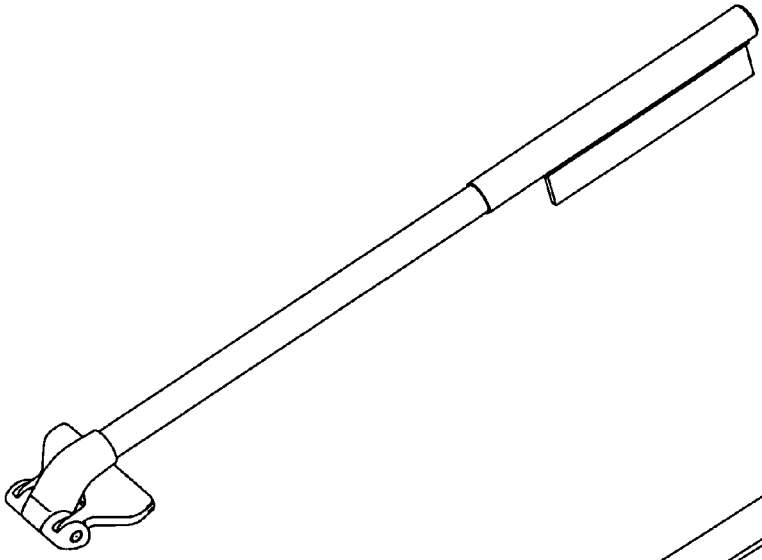
FIG. 3A is an isometric view of the first alternate embodiment shown in the stowed configuration.
Figure 3B:
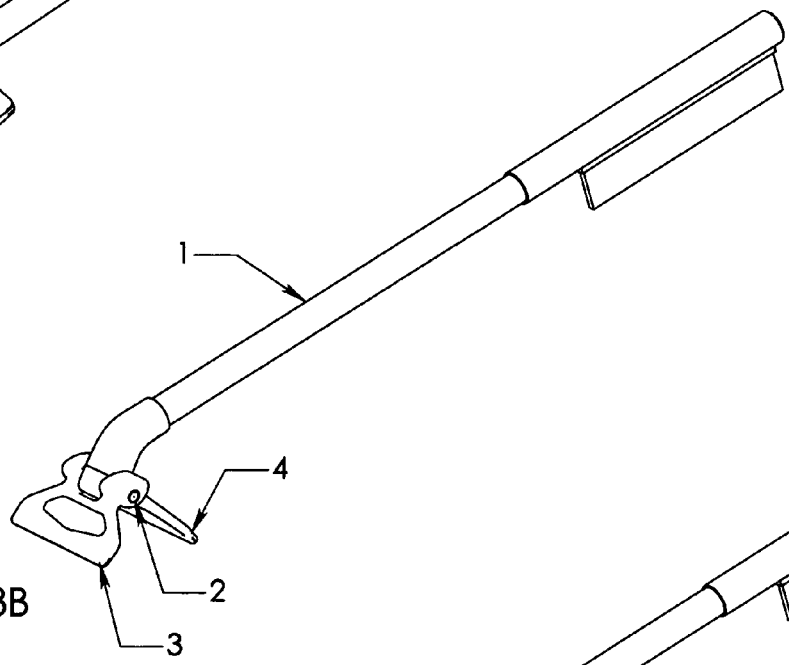
FIG. 3B is an isometric view of the first alternate embodiment shown in the working configuration
Figure 3C:
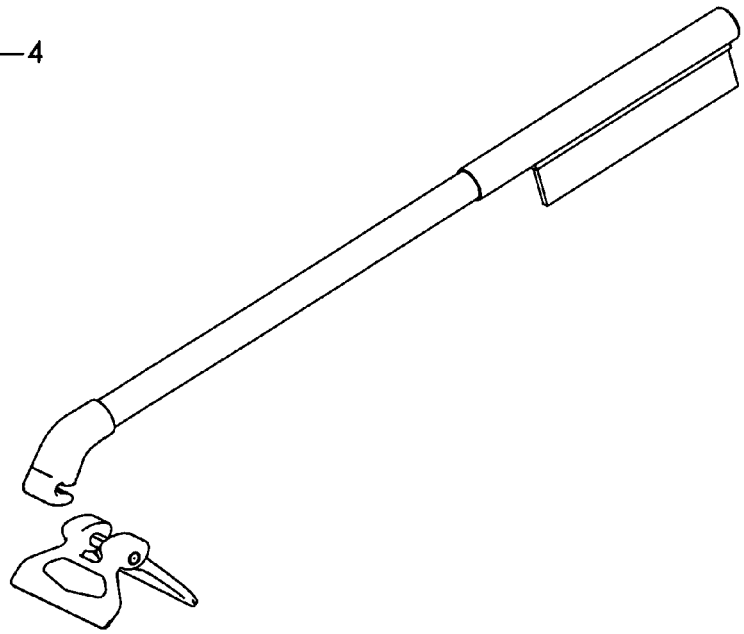

FIGS. 3A, 3B, and 3C show a second embodiment which employs a handle 12 that is removable from the scraping elements 3 and 4 and shaft 2 such that the scraping elements and shaft form an assembly which may be used by hand, separate from the handle 12 as described in the first alternate embodiment. FIG. 3A depicts a stowed version of the scraping device whereby the handle 12 is a telescoping tubular form. The handle may also include a brush 13 near the free end of the handle 12. FIG. 3B shows the deployed configuration of the 3, 4 elements relative to the handle 12. The cam features which provide the stow and deploy detents as described in the preferred embodiment are also employed functionally in this embodiment. FIG. 3C shows the same embodiment with the capability of removing the 3, 4 element assembly from the handle 12 to provide more options for the operator.

Another alternate embodiment could be configured by combining various features of the preferred and alternate embodiments. Any possible configured embodiment would contain at least two scraping elements joined by a common axis to allow the scraping elements to pivot relative to each other within confined angular limits to what has been previously described as the stowed and deployed positions.

The scraping elements of any of the device embodiments may vary in size and flexibility as required to perform most effectively for the intended work surface. The scraping elements may take a smaller and more flexible form when the intended use is for removing food from surfaces as compared with the device that is intended to be used for removing ice from auto glass or paint from a surface for example. Accordingly, the scope of the invention is to be set in the claims that follow and not limited to the configurations illustrated and explained previously.

FIGS. 4A, 4B, and 4C show a third embodiment which employs a handle 12 that is removable from the scraping elements 3 and 4 and shaft 2 such that the scraping elements and shaft form an assembly which may be used by hand, separate from the handle 12 as described in the first alternate embodiment FIG. 4A depicts a stowed version of the scraping device whereby the handle 12 is a telescoping tubular form. The handle may also include a brush 13 near the free end of the handle 12. FIG. 4B shows the deployed configuration of the 3, 4 elements relative to the handle 12. The cam features which provide the stow and deploy detents as described in the preferred embodiment are also employed functionally to this embodiment FIG. 4C shows the same embodiment with the capability of removing the 3, 4 element assembly from the handle 12 to provide more options for the operator.

A fourth embodiment could be configured by combining various features of the preferred and alternate embodiments. Any possible configured embodiment would contain at least two scraping elements joined by a common axis to allow the scraping elements to pivot relative to each other within confined angular limits to what has been previously described as the stowed and deployed positions.

The scraping elements of any of the device embodiments may vary in size and flexibility as required to perform most effectively for the intended work surface. The scraping elements may take a smaller and more flexible form when the intended use is for removing food from surfaces as compared with the device that is intended to be used for removing ice from auto glass or paint from a surface for example. Accordingly, the scope of the invention is to be set in the claims that follow and not limited to the configurations illustrated and explained previously.

The invention claimed is:

1. A hand held tool intended for scraping adhered material from a surface, said tool comprising;

(a)two similarly shaped planar elements, each said element formed with at least 2 opposing parallel edges wherein one edge of both said elements are conjoined to form a shared pivot axis and said opposing parallel edges of said elements are configured as scraping edges, (b)a handle attached to said pivot axis wherein the longitudinal axis of said handle is oriented in a perpendicular orientation to said pivot axis and mounted to said pivot axis such that said handle is permitted to pivot freely about said pivot axis to allow said two scraping edges to remain in contact with said surface independently from said handle orientation, (c)and wherein said pivot axis contains a first set of mechanical features providing a means to limit relative rotation between said planar elements such that the configuration defined by the scraping edges of both said elements having contact with said surface and said elements splayed to the maximum angular position allowed by said mechanical features will be conducive to removing material from said surface as a force is applied in a generally simultaneous downward and fore and aft manner along the axis of said handle, (d)and wherein said pivot axis contains a second set of mechanical features providing a means to deter the free motion between said planar elements such that said planar elements will remain in their maximum and minimum relative angular positions with no external force applied, (e) and wherein said pivot axis contains a third set of mechanical features providing a means to restrain said planar elements relative to said handle as said planar elements are rotably positioned in contact with said handle.

2. The scraping tool according to claim 1 wherein said first set of mechanical features at said pivot axis are comprised of a radially located male cam specifically located at each end of said pivot axis on one said planar element to provide a mechanical stop when said cam feature is rotably positioned against mating cams located on the alternate planar element such that the angle created between said planar elements at the limit provided by said cam features is 90 degrees.

3. The scraping tool according to claim 1 wherein said second set of mechanical features at said pivot axis are comprised of convex and concave features specifically located on each said planar element to allow the nesting of said features when said planar elements are positioned into their maximum and minimum angular orientations to deter relative motion between said planar elements without the application of an external torque.

4. The scraping tool according to claim 1 wherein said third set of mechanical features at said pivot axis are comprised of concave and convex features specifically located on one said planar element and said handle respectively to allow the nesting of said features when said planar element is positioned into either the maximum or minimum angular orientation relative to said handle for providing a deterrent to rotation between said elements and said handle without the application of an external torque.

* * * * *